US009208986B2

(12) United States Patent
Zou et al.

(10) Patent No.: US 9,208,986 B2
(45) Date of Patent: Dec. 8, 2015

(54) SYSTEMS AND METHODS FOR MONITORING AND CONTROLLING AN ELECTRON BEAM

(71) Applicant: General Electric Company, Schenectady, NY (US)

(72) Inventors: Yun Zou, Niskayuna, NY (US); Carey Shawn Rogers, Milwaukee, WI (US); John Scott Price, Niskayuna, NY (US); Sergio Lemaitre, Milwaukee, WI (US); Mark Alan Frontera, Niskayuna, NY (US); Peter Andras Zavodsky, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 183 days.

(21) Appl. No.: 13/672,100

(22) Filed: Nov. 8, 2012

(65) Prior Publication Data

US 2014/0126704 A1 May 8, 2014

(51) Int. Cl.

| | |
|---|---|
| ***H05G 1/02*** | (2006.01) |
| ***H01J 35/02*** | (2006.01) |
| ***H01J 35/14*** | (2006.01) |

(52) U.S. Cl.

CPC ..... *H01J 35/025* (2013.01); *H01J 35/14* (2013.01); *H01J 2235/168* (2013.01)

(58) Field of Classification Search

CPC ..... A61B 6/032; H01J 35/025; H01J 35/04; H01J 35/06; H01J 35/065; H01J 35/14; H01J 35/168; H01J 2235/06; H01J 2235/068

USPC ..... 378/16, 19, 84, 85, 111, 113, 121, 137, 378/138, 197

See application file for complete search history.

(56) References Cited

U.S. PATENT DOCUMENTS

| | | | | |
|---|---|---|---|---|
| 3,319,110 | A * | 5/1967 | Schlesinger | 315/17 |
| 5,077,771 | A * | 12/1991 | Skillicorn et al. | 378/102 |
| 5,305,363 | A | 4/1994 | Burke et al. | |
| 6,111,934 | A | 8/2000 | Foerst et al. | |
| 2004/0247080 | A1 | 12/2004 | Feda | |
| 2008/0095317 | A1 | 4/2008 | Lemaitre | |

(Continued)

OTHER PUBLICATIONS

Hussein, O. A., Determination of the most favorable shapes for the cylindrical concave electrostatic quadrupole lens, Sep. 2009, Journal of Al-Nahrain University, vol. 12, No. 3, p. 86, 93.*

(Continued)

*Primary Examiner* — Irakli Kiknadze
*Assistant Examiner* — Julio M Duarte-Carvajalino
(74) *Attorney, Agent, or Firm* — Robert M. McCarthy

(57) ABSTRACT

An X-ray tube assembly includes an electron beam transport tube, a beam tube protection assembly, and a control module. The electron beam transport tube includes an opening configured for passage of an electron beam, and includes an inner surface bounding the opening along a length of the electron beam transport tube. The beam tube protection assembly includes a plurality of beam protection electrode segments disposed within the opening of the electron beam transport tube and configured to protect the inner surface of the electron beam transport tube from contact with the electron beam. The control module is configured to determine a direction of the electron beam responsive to information received from the beam tube protection assembly.

28 Claims, 5 Drawing Sheets

(56) References Cited

U.S. PATENT DOCUMENTS

| | | | | |
|---|---|---|---|---|
| 2009/0060140 | A1* | 3/2009 | Subraya et al. | 378/125 |
| 2010/0020937 | A1 | 1/2010 | Hautmann et al. | |
| 2010/0020938 | A1* | 1/2010 | Koch et al. | 378/138 |
| 2010/0046712 | A1 | 2/2010 | Behling | |
| 2010/0061516 | A1 | 3/2010 | Freudenberger et al. | |
| 2010/0065754 | A1 | 3/2010 | Bromberg et al. | |
| 2011/0038460 | A1 | 2/2011 | Grasruck et al. | |
| 2011/0142204 | A1* | 6/2011 | Zou et al. | 378/138 |
| 2011/0286581 | A1* | 11/2011 | Sprenger et al. | 378/113 |

OTHER PUBLICATIONS

"X-Ray Beam Transport and Diagnostics" SLAC National Accelerator Laboratory, Stanford University, LCLS-II Conceptual Design Review, Chapter 8, Apr. 2011.

* cited by examiner

SYSTEMS AND METHODS FOR MONITORING AND CONTROLLING AN ELECTRON BEAM

BACKGROUND

X-ray tubes may be used in a variety of applications to scan objects and reconstruct one or more images of the object. For example, in computed tomography (CT) imaging systems, an X-ray source emits a fan-shaped beam or a cone-shaped beam toward a subject or an object, such as a patient or a piece of luggage. The terms "subject" and "object" may be used to include anything that is capable of being imaged. The beam, after being attenuated by the subject, impinges upon an array of radiation detectors. The intensity of the attenuated beam radiation received at the detector array is typically dependent upon the attenuation of the X-ray beam by the subject. Each detector element of a detector array produces a separate electrical signal indicative of the attenuated beam received by each detector element. The electrical signals are transmitted to a data processing system for analysis. The data processing system processes the electrical signals to facilitate generation of an image.

Generally speaking, in CT systems, the X-ray source and the detector array are rotated about a gantry within an imaging plane and around the subject. Furthermore, the X-ray source generally includes an X-ray tube, which emits the X-ray beam at focal point. Also, the X-ray detector or detector array in some systems includes a collimator for collimating X-ray beams received at the detector, a scintillator disposed adjacent to the collimator for converting X-rays to light energy, and photodiodes for receiving the light energy from the adjacent scintillator and producing electrical signals therefrom. In other systems, a direct conversion material, such as a semiconductor (e.g., Cadmium Zinc Telluride (CdZnTe)) may be used.

The X-ray tube, for example, may include an emitter from which an electron beam is emitted toward a target. The emitter may be configured as a cathode and the target as an anode, with the target at a substantially higher voltage than the emitter. Electrons from the emitter may be formed into a beam and directed or focused by electrodes and/or magnets. In response to the electron beam impinging the target, the target emits X-rays.

X-ray tubes are typically configured to maintain a vacuum within the X-tube through which the electron beam travels. For example, in some systems, a portion of the distance between the anode and the cathode may include a length of pipe or tube through which the electron beam travels. The length of pipe or tube may have a diameter of relatively small size to facilitate the use of magnets to create a field within the length of pipe or tube to deflect or position the electron beam. Because of the energy present in the electron beam, the electron beam may cause serious damage to the length or pipe of tube through which the electron beam passes if the electron beam strikes the interior of the length of pipe or tube. For example, if the pipe or tube becomes punctured, breached, or otherwise damaged or compromised, the vacuum within the pipe or tube may be lost and the X-ray tube may not function properly. Repair and replacement of the tube, or a vacuum casing which the tube forms a part of may be time consuming and expensive. The distance from the anode to the cathode (and the length of the pipe or tube through which the electron beam travels) is increased for certain more recently employed X-ray tube designs. Problems associated with a mis-aligned electron beam striking the inside of the pipe or tube occur more frequently and/or are exacerbated by these increased lengths of tubes or pipes through which electron beams travel.

BRIEF DESCRIPTION

In one embodiment, an X-ray tube assembly is provided. The X-ray tube assembly includes an electron beam transport tube, a beam tube protection assembly, and a control module. The electron beam transport tube is configured to be interposed between an emitter and a target of an X-ray tube, and is configured to form a part of a vacuum assembly. The electron beam transport tube includes an opening configured for passage of an electron beam emitted by the emitter. The electron beam transport tube is configured to be disposed peripherally about an axis defined by the electron beam, and includes an inner surface bounding the opening along a length of the electron beam transport tube. The beam tube protection assembly includes a plurality of beam protection electrode segments disposed within the opening of the electron beam transport tube. The beam protection electrode segments are disposed proximate the inner surface of the electron beam transport tube. The beam protection electrode segments are arranged about the axis defined by the electron beam and are configured to protect the inner surface of the electron beam transport tube from contact with the electron beam. The control module is operably connected to the beam tube protection assembly and is configured to determine a direction of the electron beam responsive to information received from the beam tube protection assembly.

In another embodiment, an X-ray tube assembly is provided. The X-ray tube assembly includes an emitter, a target, an electrode assembly, an electron beam transport tube, a beam tube protection assembly, and a control module. The emitter is configured to emit an electron beam defining a downstream direction toward a target. The emitter is disposed proximate an upstream end of the X-ray tube assembly. The target is disposed proximate a downstream end of the X-ray tube assembly and configured to receive the electron beam emitted from the emitter. The target is configured to provide an X-ray beam responsive to a collision of the electron beam with the target. The electrode assembly is disposed proximate the emitter and downstream of the emitter, and includes at least one electrode having a bias voltage with respect to the emitter, with the electrode assembly configured to surround the electron beam in an axial direction. The electron beam transport tube is configured to be interposed between the emitter and the target, and is configured to form a part of a vacuum assembly. The electron beam transport tube includes an opening configured for passage of an electron beam emitted by the emitter. The electron beam transport tube is configured to be disposed peripherally about an axis defined by the electron beam, and includes an inner surface bounding the opening along a length of the electron beam transport tube. The beam tube protection assembly includes a plurality of beam protection electrode segments disposed within the opening of the electron beam transport tube. The beam protection electrode segments are disposed proximate the inner surface of the electron beam transport tube. The beam protection electrode segments are arranged about the axis defined by the electron beam and configured to protect the inner surface of the electron beam transport tube from contact with the electron beam. The control module is operably connected to the beam tube protection assembly and is configured to determine a direction of the electron beam responsive to information received from the beam tube protection assembly.

In a further embodiment, a method for providing an electron beam (e.g., an electron beam for X-ray generation) is provided. The method includes emitting an electron beam defining a downstream direction from an emitter toward a target. The method also includes collecting information corresponding to the electron beam via a plurality of beam protection electrode segments as the electron beam passes through an electron beam transport tube configured to be interposed between the emitter and the target. The electron beam transport tube is configured to form a part of a vacuum assembly, and includes an inner surface bounding an opening along a length of the electron beam transport tube. The plurality of beam protection electrode segments are disposed within the opening of the electron beam transport tube and proximate the inner surface of the electron beam transport tube. The plurality of beam protection electrode segments are arranged about the axis defined by the electron beam and configured to protect the inner surface of the electron beam transport tube from contact with the electron beam. The method also includes determining, at a control module, a characteristic of the electron beam using information received from the plurality of beam protection electrode segments.

DETAILED DESCRIPTION

Figure 1:
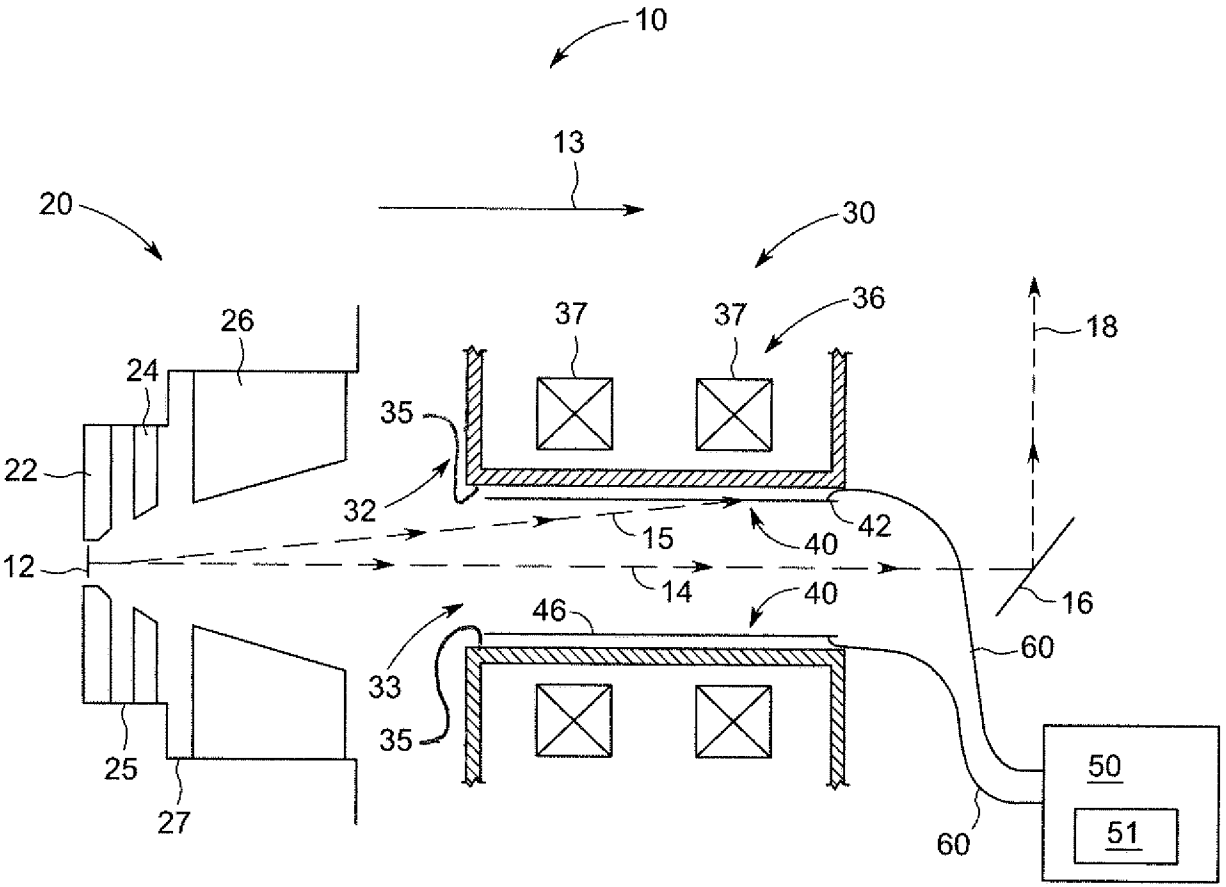
FIG. 1 is a schematic view of an X-ray tube assembly in accordance with various embodiments.

Various embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors, controllers or memories) may be implemented in a single piece of hardware (e.g., a general purpose signal processor or random access memory, hard disk, or the like) or multiple pieces of hardware. Similarly, any programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Systems formed in accordance with various embodiments provide a beam protection assembly (e.g., a beam protection assembly configured to protect an electron beam transport tube) or a beam control assembly. The assembly may be configured to protect the electron beam transport tube by providing a shield and/or by re-directing an electron beam passing through the electron beam transport tube. Further, the assembly may be used to detect or determine one or more characteristics of an electron beam, such as a direction or current, and an electron beam may be manipulated based on the determined characteristic. Further still, additionally or alternatively, the assembly may be used to re-direct the electron beam to improve image quality, for example by directing the electron beam to a desired portion of a target, or, as another example, by inducing a desired wobble in the X-ray beam. As another example, the assembly may be used to control the beam size inside the electron beam transport tube.

A technical effect of at least one embodiment includes improved protection of an electron beam transport tube from potential contact with electrons directed toward an inner surface of the electron beam transport tube. Additional technical effects of at least one embodiment include improved safety of operation, reduced down time for repairs, and/or reduced repair and/or replacement costs for X-ray tube assemblies. A technical effect of at least one embodiment includes improved flexibility and/or time requirements for adjusting an electron beam as the electron beam passes through an electron beam transport tube. A technical effect of at least one embodiment includes providing convenient and accurate non-destructive measurement of one or more characteristics of an electron beam. A further technical effect of at least one embodiment is improved image quality.

FIG. 1 is a schematic view of an X-ray tube assembly 10 formed in accordance with an embodiment. The X-ray tube assembly 10 includes an emitter 12 configured to emit an electron beam 14 in a downstream direction 13 toward a target 16. The X-ray tube assembly 10 also includes an electrode assembly 20 configured to focus or otherwise direct, shape, or influence the electron beam 14 as the electron beam proceeds in a downstream direction from the emitter 12 to the target 16. The target 16 emits an X-ray beam 18 responsive to the impingement of the electron beam 14 upon the target 16. The emitter 12 may be maintained at a negative voltage potential with respect to the target 16 so that electrons emitted from the emitter 12 flow toward the target 16.

In the illustrated embodiment, the electrode assembly 20 includes an emitter focusing electrode 22, an extraction electrode 24, and a downstream focusing electrode 26. In the illustrated embodiments, each of the emitter focusing electrode 22, extraction electrode 24, and downstream focusing electrode 26 are substantially cylindrical, or ring-shaped in cross-section, and configured to surround an axis defined by the electron beam 14 in an axial direction A depicted in FIG. 2. Returning to FIG. 1, the emitter focusing electrode 22 overlaps the emitter 12 in the downstream direction, the extraction electrode 24 is disposed downstream of the emitter 12 and the emitter focusing electrode 22, and the downstream focusing electrode 26 is disposed downstream of the extraction electrode 24. In various embodiments, one or more of the emitter focusing electrode 22, extraction electrode 24, and downstream focusing electrode 26 are provided with or maintained at a bias voltage with respect to the emitter 12 to control the shape or other feature of the electron beam 14 as the electron beam 14 progresses from the emitter 12 past the electrode assembly 20 in the downstream direction. One or more electrodes of the electrode assembly 20 may be positively biased with respect to the emitter 12 to help accelerate the electron beam 14 toward the target 16. Thus, the electrode assembly 20 may be considered an example of an acceleration section or portion of the X-ray tube assembly 10. Other numbers, types, and/or arrangements of electrodes may be employed in the electrode assembly 120 in various alternate embodiments.

In the illustrated embodiment, the emitter focusing electrode 22 and the extraction electrode 24 are mounted to a first wall 25 of the X-ray tube assembly 10, and the downstream focusing electrode 26 is mounted to a second wall 27 of the X-ray tube assembly 10. In various embodiments, other arrangements may be employed. For example, more or fewer numbers of electrodes may be employed, different mountings may be employed, and different geometries of electrodes may be employed. For example, one or more electrodes may define a polygonal cross-section with an opening therethrough instead of a ring-shaped structure as discussed above, one or more electrodes may have tapered or sloped walls with respect to the axis defined by the electron beam, and/or an inner diameter of one or more electrodes may be substantially parallel to or not sloped with respect to the axis defined by the electron beam.

The X-ray tube assembly 10 also includes an X-ray tube beam transport assembly 30. The X-ray tube beam transport assembly 30 is interposed between the emitter 12 and the target 16 in the downstream direction 13. In the illustrated embodiment, the X-ray tube beam transport assembly 30 is disposed downstream of the electrode assembly 20 and upstream of the target 16. The depicted X-ray tube beam transport assembly 30 includes an electron beam transport tube 32, a magnetic assembly 36, a beam tube protection assembly 40, and a control module 50. The X-ray tube beam transport assembly 30 may be configured to provide a path for the electron beam 14 to the target 16 as well as to focus, bend, or otherwise manipulate the electron beam 14, for example, so that the electron beam 14 strikes a desired portion or portions of the target 16. The X-ray tube beam transport assembly 30 may thus be considered a beam transport and/or manipulation portion or section of the X-ray tube assembly 10.

The electron beam transport tube 32 forms a part of a vacuum assembly through which the electron beam 14 travels to the target 16. In the illustrated embodiment, the electron beam transport tube 32 is interposed between the emitter 16 and the target 18, and is disposed downstream of the electrode assembly 20 (or acceleration portion). The electron beam transport tube 32, for example, may define a cylindrical portion that is substantially circular in cross-section. Other shapes, such as polygonal, may be used in various embodiments. The electron beam transport tube 32 includes an opening 33 through which the electron beam 14 travels, and an inner surface 35 defining an outer boundary (in an axial direction) of the opening 33. The electron beam transport tube 32 in the illustrated embodiment is configured to maintain a vacuum within the opening 33, and also to have substantially no effect or a relatively small effect on a magnetic field created by the magnetic assembly 36. The electron beam transport tube 32 in some embodiments may be made of, for example, low carbon stainless steel.

The magnetic assembly 36 is disposed around all or a portion of the electron beam transport tube 32, and is configured to provide a magnetic field to manipulate a characteristic of the electron beam 14 as the electron beam 14 passes through the electron beam transport tube 32. For example, the magnetic assembly 36 may be configured to focus, bend, re-direct, or otherwise manipulate or modify the electron beam 14, for example to position the electron beam 14 in a desired location or locations on the target 16. The magnetic assembly 36 is disposed axially outward of the electron beam transport tube 32 (with respect to an axis defined by the electron beam 14), with the magnetic assembly 36 thus located outside of the vacuum maintained within the opening 33 of the electron beam transport tube 32. In the illustrated embodiment, the magnetic assembly 36 includes magnets 37, along with any necessary mounting hardware or fixtures as well as control electronics. For example, the magnets 37 may include two quadrupole magnets oriented at about 90 degrees to each other. In some embodiments, the magnets 37 may include or more quadrupole magnets, one or more dipole magnets, or combinations thereof. As the properties of the electron beam current and voltage may change rapidly, the effect of space charge and electrostatic focusing upstream of the X-ray tube beam transport assembly 30 will change accordingly. To help maintain a stable focal spot size, or quickly modify focal spot size according to system requirements, the magnetic assembly 36 may provide a magnetic field having a performance controllable from steady-state to a sub-30 microsecond time scale for a wide range of focal spot sizes. This helps provide protection of the X-ray source system, as well as achieving CT system performance requirements. In some embodiments, an electrostatic focusing assembly may be used alternatively or additionally to the magnetic assembly 36.

In some embodiments, the electron beam 14 may travel a relatively large distance between the emitter 12 and the target 16. For example, the electron beam 14 may travel between about 300 and 400 millimeters between the emitter and the target 16 in some embodiments. If all or a portion of the electron beam 14 varies from a desired path, for example, such that a path is followed as depicted for electron beam 15 of FIG. 1, such an electron beam (if left unhindered or unmodified) may tend to impinge on the inner surface 35 of the electron beam transport tube 32. Due to the energy present in the electron beam 15 (for example, an electron beam having a current of about 1 milliampere (mA) traveling between an emitter and a target having a 140 kilovolt difference in electric potential, may provide about 140 watts in a relatively small area). Such an impingement by the electron beam 15 may cause damage to the electron beam transport tube 32. If the electron beam transport tube 32 becomes breached, the vacuum inside the X-ray tube assembly 10 may be lost and the X-ray tube assembly 10 may thus require a time consuming and/or expensive replacement or repair. In the illustrated embodiment, the X-ray tube assembly 10 includes a beam protection tube assembly 40 configured to protect the electron beam transport tube 32.

The beam tube protection assembly 40 includes a plurality of beam protection electrode segments (see also, e.g., FIG. 2 and related discussion regarding beam protection electrode segments, 42, 44, 46, 48) disposed within the opening 33 of the electron beam transport tube 32. The plurality of beam protection electrode segments are disposed proximate to the inner surface 35 of the electron beam transport tube 32, and are arranged about an axis defined by the electron beam 14. For example, the beam tube protection assembly 40 may include a plurality of beam protection electrode segments that define a ring shape corresponding to a circular cross-section of the electron beam transport tube 32. Other shapes, such as polygonal, may be used in other embodiments. Each piece or segment may be part of a cylinder (e.g., with thin walls) or each piece or segment may be any arbitrary shape. In some embodiments, the beam tube protection assembly 40 may include an even number of beam protection electrode segments arranged as opposed pairs, with one member of each opposed pair being substantially the same size as the other member of the opposed pair. In other embodiments, the beam tube protection assembly 40 may include an odd number of beam protection electrode segments. In some embodiments, the beam tube protection assembly 40 may include four beam protection electrode segments, each subtending about 90 degrees (the segments may subtend slightly less than 90 degrees to permit a small gap between the segments). In alternate embodiments, the beam tube protection assembly may include more or fewer electrode segments. For example, in some embodiments, a solid cylindrical electrode may be employed, while in still other embodiments a protective sleeve that is not configured as an electrode (e.g., is not operably connected to a voltage source and/or a module for control or detection of an electron beam) may be employed. Further still, in some embodiments, beam protection electrodes may be segmented longitudinally (e.g., segmented along a length along the downstream direction 13) additionally and/or alternatively to being segmented along a circumference or periphery surrounding an axis defined by the electron beam 14. One or more beam protection electrode segments, in various embodiments, may be made of high temperature material such as tungsten or nickel, or coated with such a material.

The beam protection electrode segments are configured to protect the electron beam transport tube 32 from contact with the electron beam (e.g., electron beam 15). For example, the beam protection electrode segments are positioned between the center of the opening 33 and the inner surface 35, and therefore are configured to intercept all or a portion of an electron beam that may otherwise impinge on the electron beam transport tube. Replacement of one or more beam protection electrode segments may be considerably easier, quicker, and/or less expensive than repair or replacement of the electron beam transport tube 32 in the event of damage done due to contact with an electron beam.

As another example, the beam tube protection assembly 40 may be configured to measure, detect, or determine one or more electron beam characteristics, such as current and direction, which may be used to adjust or control the electron beam, for example, to re-direct an electron beam to protect the electron beam transport tube 32. One or more beam protection electrodes may be configured to detect electron beam flow. The detection or determination may be performed in conjunction with one or more modules (e.g., control module 50 and/or other modules associated therewith) that receive a signal from one or more beam protection electrode segments. For example, one or beam protection electrodes may send information to the control module 50 via leads 60, with the control module 50 configured to determine a current and/or direction of the electron beam using the information received via the leads 60. The detection may be indirect (e.g., by an induced voltage detected by one or more beam protection electrode segments as measured or determined by a control module receiving a signal from the beam protection electrode(s)) or direct (e.g., by an indicated collision of a portion of an electron beam with one or more beam protection electrodes). The indirect detection (e.g., by an induced voltage detected by one or more beam protection electrode segments) may provide for non-destructive measurement of a beam characteristic, such as current, whereas certain known measurement techniques include placement of an object in the path of an electron beam. Measurement of the electron beam within the X-ray tube beam transport assembly 30 may also be more accurate than, for example, a measurement of current at the anode (e.g., target 16) and/or more convenient than, for example, a measurement of current at the cathode (e.g., emitter 12).

Further still, in some embodiments, the control module 50 (in conjunction with additional control modules in some embodiments) may use the measured, detected, or determined characteristics of an electron beam to change or modify a characteristic of the electron beam, such as intensity or direction of beam. For example, the control module 50 may be configured to control the emitter and/or the target to change the voltage potential therebetween, which may in turn change the current of the electron beam. The control module 50 may, alternatively or additionally, control a bias voltage of one or more electrodes of the electrode assembly 20 to adjust, for example, an intensity of the electron beam and/or to focus the electron beam. Further still, alternatively or additionally, the control module 50 may control one or more of the magnets 37 of the magnetic assembly 36 to adjust or manipulate the electron beam. For example, if it is determined that the electron beam (e.g., electron beam 15) is striking a beam protection electrode segment (or is within a threshold distance of striking a beam protection electrode segment), the magnetic assembly 36 may be controlled to deflect the electron beam so that the electron beam is directed more centrally through the opening 33 (e.g., substantially aligned with depicted electron beam 14).

As still another example, the beam protection electrode segments may be configured to protect the electron beam transport tube 32 by being configured to re-direct an electron beam (e.g., electron beam 15) that is oriented such that the electron beam may otherwise impinge upon a portion of the X-ray tube beam transport assembly 30 (or other portion of the X-ray tube assembly 10). In some embodiments, differential voltages may be applied to the members of an opposed pair of beam protection electrode segments to re-direct an electron beam. For example, the member of the opposed pair that is further from the current direction of the electron beam may be adjust to have a more positive voltage bias with respect to the member of the opposed pair that is closer to the current direction of the electron beam (or, the member of the opposed pair that is closer the current direction of the electron beam may be adjust to have a more negative voltage bias with respect to the member of the opposed pair that is farther from the current direction of the electron beam) to re-direct the direction of the electron beam away from the beam protection electrode segment that the electron beam is currently closer to. Thus, in some embodiments, the direction or path of an electron beam through the X-ray tube beam transport assembly 30 may be manipulated magnetically, (e.g., via a magnetic field provided by the magnetic assembly 36) and/or electrostatically (e.g., via an electric field provided by differential voltages applied to the beam protection electrode segments). Generally speaking, the magnetic control may provide for increased magnitude of available manipulation of an electron beam, while electrostatic control may provide for more rapid adjustment of an electron beam.

Further, appropriate voltages may be applied to opposing beam protection electrode segments to change the beam size and/or improve the focal spot size on a target. For example, if positive bias voltages (relative to the beam) are applied to both opposing electrodes, the beam size may be reduced. If negative bias voltages are applied to both opposing electrodes, the beam size can be increased. In combination with other focusing elements of a system, the focal spot size on a target may be finely tuned.

Further still, the beam protection electrode segments may be used to further control the electron beam to control the resulting X-ray beam 18 for improved imaging. For example, voltages may be applied to various beam protection electrode segments to provide beam wobble of a resulting X-ray beam in a Z direction (e.g., an examination axis along which a patient lies) and/or an x direction (e.g., an axis perpendicular to the Z axis), which may be used to improve image spatial resolution.

The control module 50, which may include a memory 51 associated therewith, may be configured to determine a characteristic, such as a current and/or a direction of the electron beam 14 and/or to provide control signals or instructions to adjust the current and/or direction of the electron beam 14. The control module 50 may be operably connected (either directly, or indirectly via additional control modules associated with various components of the X-ray tube assembly 10) with one or more of the beam tube protection assembly 40 (e.g., beam protection electrode segments of the beam tube protection assembly 40), the magnetic assembly 36, the electrode assembly 20, the emitter 12, or the target 16. For example, if the control module 50 determines that a current of the electron beam 14 should be adjusted, the control module 50 may provide an appropriate control instruction to adjust a voltage applied to the emitter 12 and/or the target 16 to increase or decrease the current of the electron beam 14, as appropriate. As another example, the control module 50 may provide an appropriate control instruction to adjust a bias voltage (with respect to the emitter 12) of one or more electrodes of the electrode assembly 20 to adjust an intensity of the electron beam 14 and/or to focus or de-focus the electron beam 14. Further still, the control module 50 may provide an appropriate control instruction to the magnetic assembly 36 and/or the beam tube protection assembly 40 to bend or otherwise re-direct the electron beam 14 to prevent contact between the electron beam 14 and the electron beam transport tube 32 and/or the beam tube protection assembly 40. The control module 50 may include one or more sub-modules, with, for example, each sub-module corresponding to a particular beam protection electrode and configured to measure an electron beam property and/or determine an electron beam property and/or alter a voltage of the particular corresponding beam protection electrode.

The control module 50 (or sub-modules associated therewith) may be configured to receive a signal or information from one or more of the beam protection electrode segments, and to determine a property or characteristic of the electron beam 14 using the signal or information received. For example, the information may correspond to a direct detection of the electron beam (e.g., information corresponding to a collision between the electron beam and one or more beam protection electrode segments) and/or an indirect sensing or detection of the electron beam (e.g., information corresponding to an induced voltage in one or more beam protection electrode segments). In some embodiments, the direct detection and indirect detection may provide different signatures used by the control module 50 to determine which type of information is being provided and/or if the electron beam is contacting a beam protection electrode segment. In some embodiments, the control module 50 may add information from all of the beam protection electrode segments of a beam tube protection assembly (e.g. beam tube protection assembly 40) to determine a total current of the electron beam.

As indicated above, the control module 50 may control voltages applied to opposing beam protection electrode segments to change the beam size and/or improve the focal spot size on a target. For example, if positive bias voltages (relative to the beam) are applied to both opposing electrodes, the beam size may be reduced. If negative bias voltages are applied to both opposing electrodes, the beam size can be increased. In combination with other focusing elements of a system, the focal spot size on a target may be finely tuned. Further still, the control module may control voltages applied to the beam protection electrode segments to further control the electron beam to control the resulting X-ray beam for improved imaging. For example, voltages may be applied to various beam protection electrode segments to provide beam wobble of a resulting X-ray beam in a Z direction (e.g., an examination axis along which a patient lies) and/or an x direction (e.g., an axis perpendicular to the Z axis), which may be used to improve image spatial resolution.

In some embodiments, the control module 50 may be configured to turn off the electron beam responsive to information received from the beam protection electrodes indicating a direct contact between the electron beam and the beam protection electrodes. The electron beam may be turned off, for example, by applying an appropriate negative voltage to an extraction electrode (e.g., extraction electrode 140), or, as another example, by turning off a heating element of the emitter.

Figure 2:
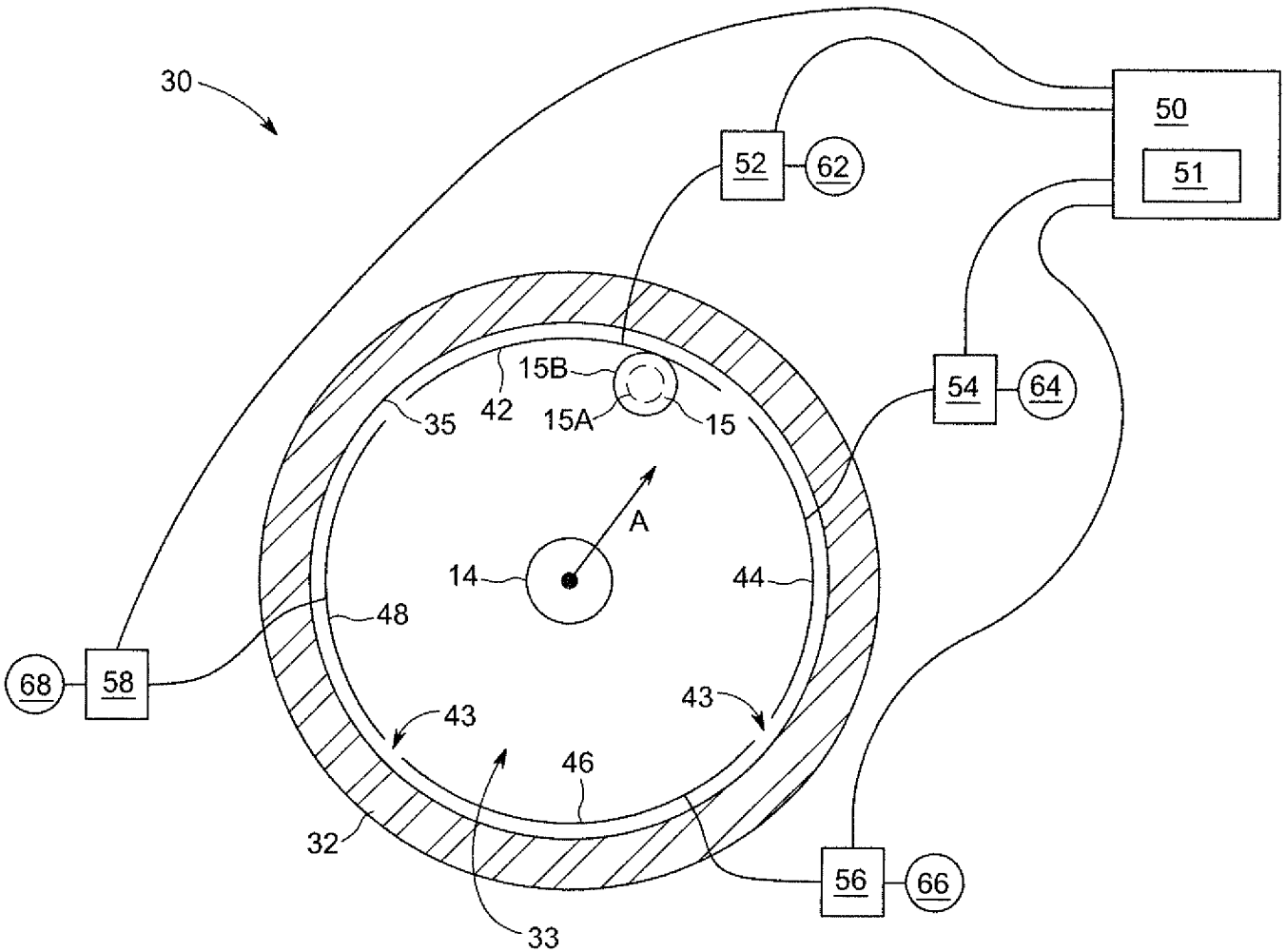
FIG. 2 is a sectional view through an X-ray tube beam transport assembly of the X-ray tube assembly of FIG. 1.

FIG. 2 is a sectional view through the X-ray beam tube transport assembly 30 of the X-ray tube assembly 10 of FIG. 1 in accordance with various embodiments. The X-ray tube assembly 10, as also discussed above, includes an electron beam transport tube 32 having an inner surface 35 defining a boundary of an opening 33 through which an electron beam (e.g., electron beam 14, electron beam 15) may pass. A central axis through the X-ray beam tube transport assembly 30 is defined by the electron beam 14 (which flows substantially through the center of the electron beam transport tube 32. An axial direction A extends from the axis defined by the electron beam 14.

The beam tube protection assembly 40 includes a first beam protection electrode segment 42, a second beam protection electrode segment 44, a third beam protection electrode segment 46, and a fourth beam protection electrode segment 48. The beam protection electrode segments 42, 44, 46, 48 are arranged in a ring-shaped pattern about the axis defined by the electron beam 14, and are separated by gaps 43. In some embodiments, the gaps 43 are sized to be a minimum distance to allow the various beam protection electrode segments to be maintained at substantially different voltages while still preventing as much as possible the passage of all or a portion of an electron beam through one or more of the gaps 43. The beam protection electrode segments are arranged, in the depicted embodiment, with the first beam protection electrode segment 42 and the third beam protection electrode segment 46 forming an opposed pair (opposed generally about a horizontal axis in the sense of FIG. 2), and with the second beam protection electrode segment 44 and the fourth beam protection electrode segment 48 forming an opposed pair (opposed generally about a vertical axis in the sense of FIG. 2).

Each of the beam protection electrode segments 42, 44, 46, 48 of the illustrated embodiment have associated therewith a corresponding segment control module 52, 54, 56, 58 and segment voltage supply 62, 64, 66, 68. The respective segment control modules 52, 54, 56, 58 receive information from a respective beam protection electrode segment 42, 44, 46, 48 corresponding to an electron beam flowing past the beam protection electrode segments. Information, for example, information transmitted via an electrical signal, may be sent from the beam protection electrode segments 42, 44, 46, 48 to the segment control modules and/or the control module 50 via one or more lines passing through a vacuum feedthrough. For example, the information may correspond to a voltage induced in the beam protection electrode segments by the passage of the electron beam. The information may also correspond to a collision between an electron beam and one or more beam protection electrode segment. In the illustrated embodiment, each segment control module receives information from a corresponding beam protection electrode segment and determines a characteristic of the electron beam corresponding to the corresponding beam protection electrode segment, and forwards the information and/or determination to the control module 50. The control module 50 then uses the information from each of the segment control modules 52, 54, 56, 58 to determine a characteristic of the electron beam, such as a total current and/or a direction. For example, the control module 50 may sum information from the segment control modules 52, 54, 56, 58 to determine a total current. As another example, the control module 50 may compare the relative strengths or amplitudes of information (e.g., information corresponding to a voltage and/or a current) from the segment control modules 52, 54, 56, 58 to determine a direction of an electron beam.

The electron beam, in some situations, may contact a portion of a beam transport tube. For example, if a voltage to a focusing electrode and/or a current to a magnetic focusing assembly is lost or otherwise compromised, the electron beam may strike the beam transport tube. In some embodiments, the control module 50 (and/or one or more of the segment control modules 52, 54, 56, 58) may further be configured to identify whether an electron beam is contacting one or more beam protection electrode segments based on a signature, profile, or other characteristic of the information provided via the particular beam protection electrode. For example, a signal or information provided may have a substantially stronger amplitude when the electron beam is striking a beam protection electrode. In the embodiment depicted in FIG. 2, the electron beam 15 defines an outer edge 15*b* that corresponds to an envelope through which electrons of the electron beam flow. The outer edge 15*b* is depicted as contacting the first beam protection electrode segment 42, with the first beam protection electrode segment 42 thus acting to shield or protect the inner surface 35 of the electron beam transport tube 32. The first beam protection electrode segment 42 may also be used to measure or detect a characteristic of the electron beam 15. For example, an induced voltage in the beam protection electrode segment 42 due to the electron beam 15 may be measured. Such an induced voltage may correspond to an average or mean position of the electron beam 15, but may not provide information corresponding to whether or not the electron beam 15 is in contact with the beam protection electrode segment 42. For example, an electron beam having an outer edge 15*b* may appear similarly to an electron beam having an outer edge 15*a* (shown in dashed line) based on induced voltage, provided the average or mean position of the electron beams are the same. Thus, additional information or signals may be obtained via a given beam protection electrode segment to allow a determination of whether or not the given beam protection electrode segment is being contacted by the electron beam. Thus, in some embodiments, more than one measurement of the electron beam may be obtained (e.g., an induced voltage along with a measure of direct contact).

In the illustrated embodiment, each of the segment control modules 52, 54, 56, 58 has associated therewith and is operably connected to a segment voltage supply 62, 64, 66, 68. In some embodiments, responsive to control signals provided by the control module 50, each of the segment control modules 52, 54, 56, 58 provides a voltage from the corresponding voltage supply 62, 64, 66, 68 to the corresponding beam protection electrode segment 42, 44, 46, 48 to control the path or re-direct the flow of an electron beam. For example, differential voltages may be supplied to electrode segments to guide, steer, or otherwise redirect an electron beam. In some embodiments, different voltages are applied to members of an opposed pair of electrodes to re-direct an electron beam flow along an axis passing through the opposed pair.

In some embodiments, differential voltages may be provided to beam protection electrode segments to steer, guide, or otherwise redirect an electron beam that would otherwise contact or be at increased risk of contacting the inner surface 35 and/or one or more of the beam protection electrode segments. For example, two electron beams are depicted in FIG. 2. The electron beam 14 is depicted as passing substantially centrally through the opening 33 (e.g., in a relatively safe position eliminating or minimizing electron beam contact), while the electron beam 15 (with outer edge 15*b*) is depicted as being off-center with respect to the opening 33 to an extent that the electron beam 15 is contacting the first beam protection electrode segment 42. It thus may be desired to redirect the electron beam 15 so that the electron beam 15 is more centrally located in the opening 33 to reduce or eliminate the risk of electron beam contact (e.g., to a position corresponding to the position of electron beam 14 in FIG. 2). In some embodiments, common voltages (both negative or both positive) may be provided to opposed beam protection electrode segments to focus an electron beam.

Voltages supplied to various beam protection electrode segments may be controlled to redirect the electron beam 15. For example, differential voltages may be applied to the first beam protection electrode segment 42 and the third beam protection electrode segment 46 to re-direct the electron beam 15 downward in the sense of FIG. 2. By providing the third beam protection electrode 46 with a more positive voltage than the first beam protection electrode 42, the electron beam 15 may be drawn toward the third beam protection electrode 46 (e.g., downward in the sense of FIG. 2). For example, a voltage of V may be provided to the third beam protection electrode 46 while a voltage of −V may be provided to the first beam protection electrode 42. The voltages provided may be varied or adjusted until the electron beam is in a desired position. Further, the electron beam 15 in FIG. 2 is also located right of center in the sense of FIG. 2. Thus, a more positive voltage may be applied to the fourth beam protection electrode segment 48 than the second beam protection electrode segment 44 to draw the electron beam 15 toward the fourth beam protection electrode segment 48 (e.g., to the left in the sense of FIG. 2). Thus, by controlling the voltages of multiple opposed pairs of beam protection electrodes, an electron beam may be re-directed along one or more axes. Additionally or alternatively, the electron beam may be re-directed by other techniques, for example, by controlling the magnets 37 of the magnetic assembly 36 to re-direct the electron beam. In some embodiments, a direction of an electron beam may be monitored substantially continuously, and, if the direction of the electron beam exceeds a threshold difference from the desired position (or becomes less than a threshold distance from a boundary or limit as the electron beam approaches contact with a beam protection electrode segment), then the electron beam may be re-directed toward a desired position. For example, the control module 50 may autonomously monitor the direction of the electron beam, and autonomously adjust the direction and/or current of the electron beam to prevent or minimize contact between the electron beam and the beam protection electrode segments. In some embodiments, the control module 50 may be configured to stop the emission of electrons from the emitter if the control module 50 is unable to prevent contact between the electron beam and one or more portions of the X-ray tube assembly 10.

In various embodiments, the direction of the electron beam may be controlled to be located or positioned elsewhere than the position indicated by the electron beam 14 in FIG. 2. For example, in some embodiments, it may be desirable to position the electron beam slightly off-center within the opening to strike a desired portion of the target 16. The voltages of one or more beam protection electrode segments may be controlled to produce such an orientation. As another example, in some embodiments, imaging may be improved by the inducement of a wobble in an X-ray beam along one or more axes. The voltages of one or more beam protection electrodes may be controlled (e.g., by a periodic, relatively small amplitude variation in voltage) to produce a periodic movement of the direction or orientation of the electron beam that results in a wobble along one or more axes of the X-ray beam resulting from the collision of the electron beam with the target.

The above discussed arrangement is intended to be illustrative and not limiting in nature. For example, in alternate embodiments, fewer or more segment control modules and/or voltage supplies may be employed and/or may be shared among segments, all or a portion of the functionality of a given control module may be shared or transferred to a different control module, one or more of the segment control modules may be integrated into a central control module (e.g., control module 50), all or a portion of the functionality of the segment control modules and/or control module 50 may be integrated into a control module that also controls additional portions of an X-ray system (e.g., magnetic assemblies (e.g., magnetic assembly 36) and/or electrode assemblies (e.g., electrode assembly 20)), and the like. One or more control modules may have a display module (e.g., screen, touchscreen, printer, or the like) and/or input module associated therewith (e.g., keyboard, touchscreen, or the like).

Figure 3:
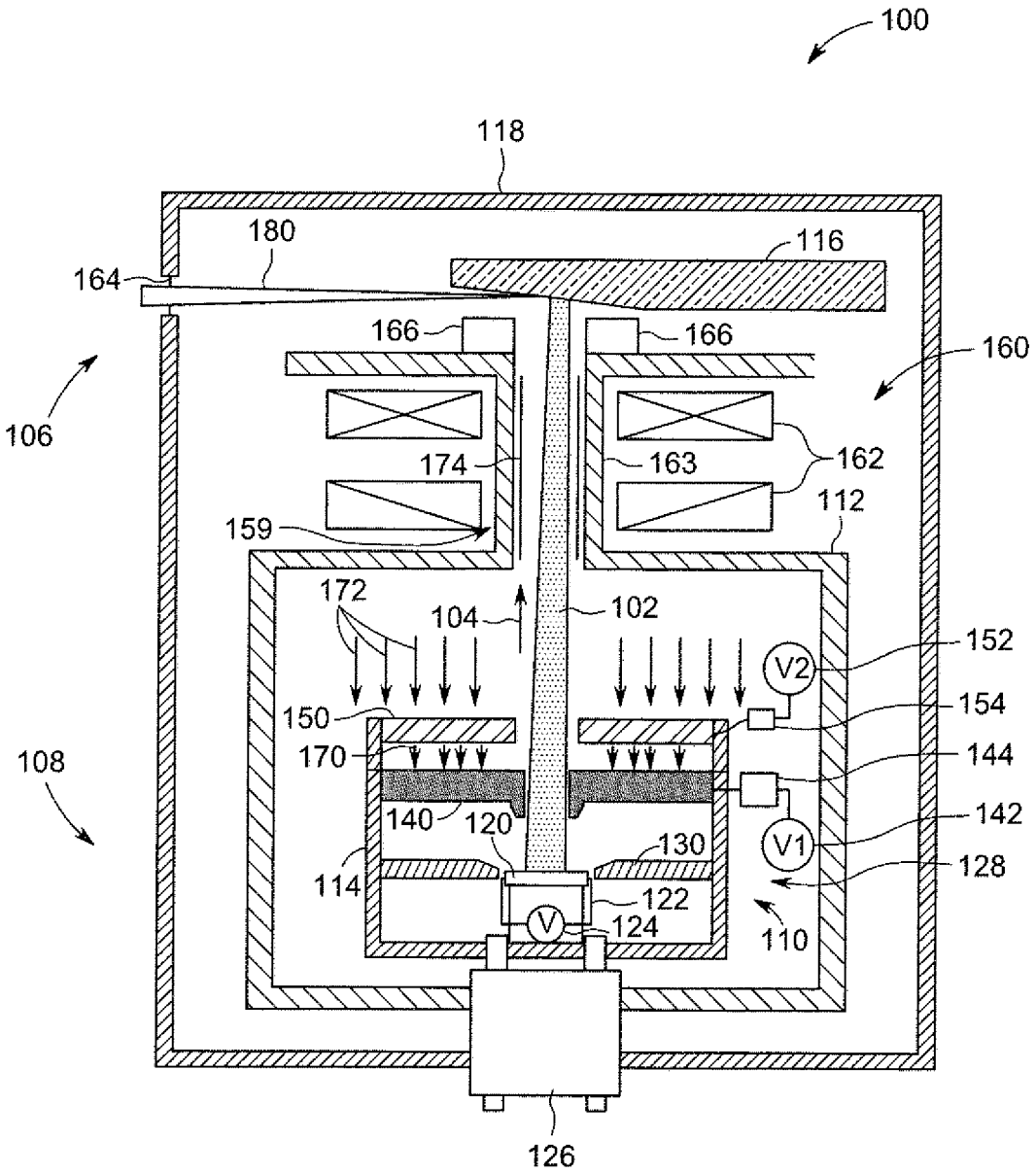
FIG. 3 is a sectional view of an X-ray tube assembly in accordance with various embodiments.

FIG. 3 is a sectional view of an X-ray tube assembly 100 formed in accordance with various embodiments. The X-ray tube assembly 100 may include an X-ray tube beam transport assembly (e.g., X-ray tube beam transport assembly 30) and a beam tube protection assembly (e.g., beam tube protection assembly 40). The X-ray tube assembly 100 includes an injector 110 disposed within a vacuum wall 112. An electron beam transport tube 163 may be formed integrally with the vacuum wall 112 and provide a conduit through which the electron beam 102 passes. The injector 110 may further include an injector wall 114 that encloses various components of the injector 110. In addition, the X-ray tube assembly 100 may also include an anode or target 116. The anode 116 is typically an X-ray target. The injector 110 and the target 116 are disposed within a tube casing 118. In some embodiments, the injector 110 may include at least one cathode in the form of an emitter 120. The cathode (e.g., emitter 120) may be directly heated in some embodiments, and indirectly heated in some embodiments. In the illustrated embodiment, the emitter 120 is coupled to an emitter support 122, with the emitter support 122 in turn coupled to the injector wall 114. The emitter 120 may be heated, for example, by passing a relatively large current through the emitter 120. A voltage source 124 may supply this current to the emitter 120. In some embodiments, a current of about 10 amps may be passed through the emitter 120. The emitter 120 may emit an electron beam 102 as a result of being heated by the current supplied by the voltage source 124. As used herein, the term "electron beam" may be used to refer to as a stream of electrons that have substantially similar velocities. The electron beam 102 defines a downstream direction 104 as the direction from the emitter 120 to the target 116. The X-ray assembly 100 includes a downstream end 106 and an upstream end 108, with the emitter 120 disposed proximate the upstream end 108 and the target 116 disposed proximate the downstream end 106. The electron beam 102 may have a substantially uniform width, diameter, or cross-section along one or more portions of the length of the electron beam 102. In practice, other profiles may be employed. For example, the size of the electron beam 102 may be reduced or increased along the length of the electron beam 102.

The electron beam 102 may be directed towards the target 116 to produce X-rays 180. More particularly, the electron beam 102 may be accelerated from the emitter 120 towards the target 116 by applying a potential difference between the emitter 120 and the target 116. In some embodiments, a high voltage in a range from about 40 kiloVolts (kV) to about 450 kV may be applied via use of a high voltage feedthrough 126 to set up a potential difference between the emitter 120 and the target 116, thereby generating a high voltage main electric field 172 to accelerate the electrons in the electron beam 102 towards the target 116. In some embodiments, a high voltage potential difference of about 140 kV may be applied between the emitter 120 and the target 116. It may be noted that in some embodiments, the target 116 may be at ground potential. For example, in some embodiments, the emitter 120 may be at a potential of about −140 kV and the target 116 may be at ground potential or about zero volts.

In alternative embodiments, the emitter 120 may be maintained at ground potential and the target 116 may be maintained at a positive potential with respect to the emitter 120. By way of example, the target 116 may be at a potential of about 140 kV and the emitter 120 may be at ground potential or about zero volts.

When the electron beam 102 impinges upon the target 116, a large amount of heat may be generated in the target 116. The heat generated in the target 116 may be significant enough to melt the target 116. In some embodiments, a rotating target may be used to address the problem of heat generation in the target 116. For example, in some embodiments, the target 116 may be configured to rotate such that the electron beam 102 striking the target 116 does not cause the target 116 to melt since the electron beam 102 does not strike the target 116 substantially continuously at the same location. In some embodiments, the target 116 may include a stationary target. The target 116 may be made of a material that is capable of withstanding the heat generated by the impact of the electron beam 102. For example, the target 116 may include materials such as, but not limited to, tungsten, molybdenum, or copper.

In the illustrated embodiment, the emitter 120 is a flat emitter. In alternative configurations the emitter 120 may be a curved emitter. The curved emitter, which is typically concave in curvature, provides pre-focusing of the electron beam. As used herein, the term "curved emitter" may be used to refer to an emitter that has a curved emission surface. Further, the term "flat emitter" may be used to refer to an emitter that has a flat emission surface. In some embodiments, shaped emitters may also be employed. For example, in some embodiments, various polygonal shaped emitters such as a square emitter or a rectangular emitter may be employed. Other shaped emitters such as elliptical or circular emitters may also be employed. It may be noted that emitters of different shapes or sizes may be employed based on particular requirements for a given application.

In some embodiments, the emitter 120 may be formed from a low work-function material. More particularly, the emitter 120 may be formed from a material that has a high melting point and is capable of stable electron emission at high temperatures. The low work-function material may include materials such as, but not limited to, tungsten, thoriated tungsten, lanthanum hexaboride, and the like.

The injector 110 of the illustrated embodiments includes an electrode assembly 128 including an emitter focusing electrode 130, an extraction electrode 140, and a downstream focusing electrode 150. In the illustrated embodiments, the emitter focusing electrode 130 is disposed proximate the emitter 120, the extraction electrode 140 is disposed downstream of the emitter focusing electrode 130 and the emitter 120, and the downstream focusing electrode 150 is disposed downstream of the extraction electrode 140, with the extraction electrode 140 thus interposed between the emitter focusing electrode 130 and the downstream focusing electrode 150. The electrode assembly 128, or portions thereof, may be mounted to and/or enclosed by the injector wall 114. The particular geometries or arrangements of electrodes depicted in FIG. 1 are provided for clarity of illustration and understanding and may differ in various embodiments. For example, one or more of the electrodes (e.g., the downstream focusing electrode) may have a larger outer diameter than other electrodes (e.g., the emitter focusing electrode and/or extraction electrode) and/or be mounted to an alternative wall or structure than injector wall 114. Also, one or more of the electrodes (e.g., the downstream focusing electrode) may have a greater length along an axis defined by the electron beam than other electrodes (e.g., the emitter focusing electrode and/or extraction electrode). Further, one or more of the electrodes may have a tapered bore, for example, a bore having a larger inner diameter at a downstream end and a smaller inner diameter at an upstream end. In alternate embodiments, other quantities, types, and/or arrangements of electrodes may be employed as part of the electrode assembly 128.

The emitter focusing electrode 130 is disposed proximate to the emitter 120. In the illustrated embodiment, the emitter focusing electrode 130 is positioned such that at least a portion of the emitter focusing electrode 130 overlaps at least a portion of the emitter 120 in the downstream direction 104, with the portion of the emitter focusing electrode 130 that overlaps the emitter 120 disposed axially outward (with the electron beam 102 defining the axis) from the emitter 120 and surrounding the emitter 120 in the axial direction. In some embodiments, the emitter focusing electrode is formed as a substantially continuous annular member (e.g., a ring). In alternate embodiments, other shapes may be employed for the emitter focusing electrode 130 (e.g., elliptical, polygonal, or the like).

In some embodiments, one or more portions of the emitter focusing electrode 130 may be maintained at a voltage potential that is less than a voltage potential of the emitter 120. The potential difference between the emitter 120 and the emitter focusing electrode 130 inhibits the movement of electrons generated from the emitter 120 from moving towards the emitter focusing electrode 130. For example, the emitter focusing electrode 130 may be maintained at a negative potential with respect to that of the emitter 120, with the negative potential with respect to the emitter 120 acting to focus the electron beam 102 away from the emitter focusing electrode 130, thereby facilitating focusing the electron beam 102 towards the target 116.

In some embodiments, one or more portions of the emitter focusing electrode 130 may be maintained at a voltage potential that is equal to or substantially similar to the voltage potential of the emitter 120. The similar voltage potential of the emitter focusing electrode 130 with respect to the voltage potential of the emitter 120 helps generate a substantially parallel electron beam by shaping electrostatic fields due the shape of the emitter focusing electrode 130. The emitter focusing electrode 130 may be maintained at a voltage potential that is equal to or substantially similar to the voltage potential of the emitter 120 via use of a lead (not shown in FIG. 3) that couples the emitter 120 and the emitter focusing electrode. Additionally or alternatively, the voltage potential of the emitter focusing electrode 130 may be adjustable between a potential substantially similar to the potential of the emitter 120 and a negative potential with respect to the potential of the emitter 120.

The electrode assembly 128 of the injector 110 further includes an extraction electrode 140 disposed proximate to and downstream of the emitter focusing electrode 130. The extraction electrode 140 is also disposed downstream of the emitter 120 and upstream with respect to the target 116, and is configured to additionally shape, control, and/or focus the electron beam 102. In the illustrated embodiment, the extraction electrode 140 is formed as generally continuous ring shaped member disposed axially outwardly of the emitter 120 and the electron beam 102. In alternate embodiments, other shapes may be employed for the extraction electrode 140 (e.g., elliptical, polygonal, or the like).

In some embodiments, one or more portions of the extraction electrode 140 may have a bias voltage with respect to the emitter 120. For example, a bias voltage power supply 142 may supply a voltage to the extraction electrode 140 such that the extraction electrode 140 is maintained at a bias voltage with respect to the emitter 120. In some embodiments, the bias voltage may be variable. The bias voltage of the extraction electrode 140 may be adjusted via a control electronics module 144, which may control the bias voltage responsive to an operator input from, for example, an operator console.

The electrode assembly 128 of the injector 110 further includes a downstream focusing electrode 150 disposed proximate to and downstream of the extraction electrode 140. In the illustrated embodiment, one downstream focusing electrode 150 is shown. In some embodiments, additional downstream focusing electrodes may be employed. The downstream focusing electrode 150 is thus also disposed downstream of the emitter 120 and upstream with respect to the target 116, and is configured to additionally shape, control, and/or focus the electron beam 102. In the illustrated embodiment, the downstream focusing electrode 150 is formed as generally continuous ring shaped member disposed axially outwardly of the emitter 120 and the electron beam 102. In alternate embodiments, other shapes may be employed for the downstream focusing electrode 150 (e.g., elliptical, polygonal, or the like).

One or more portions of the downstream focusing electrode 150 may be positively biased with respect to the emitter 120. For example, a bias voltage power supply 152 may supply a voltage to the downstream focusing electrode 150 such that the extraction electrode 140 is maintained at a positive bias voltage with respect to the emitter 120. In some embodiments, the positive bias voltage may be variable. For example, the positive bias voltage may be variable between a maximum amplitude of positive bias voltage and a minimum amplitude of positive bias voltage. The bias voltage of the downstream focusing electrode 150 may be adjusted via a control electronics module 154, which may control the bias voltage responsive to an operator input from, for example, an operator console. For example, a number of pre-set voltages may be selectable between the maximum positive bias voltage and the minimum positive voltage bias, or, as another example, the bias voltage may be substantially continuously adjustable between the maximum positive bias voltage and the minimum positive voltage bias (e.g., via use of a dial, slider, or the like on a control panel or operator console).

It may be noted that, in an X-ray tube, energy of an X-ray beam may be controlled via one or more of a plurality of techniques. For example, the energy of an X-ray beam may be controlled by altering the potential difference (e.g., acceleration voltage) between the cathode (e.g., emitter) and the anode (e.g., target), or by filtering a beam. This may be generally referred to as "kV control." The intensity of an X-ray beam may also be controlled via control of the electron beam current. (As used herein, the term "electron beam current" refers to the flow of electrons per second between the cathode and the anode.) Such a technique of controlling the intensity may be generally referred to as "mA control." As discussed herein, aspects of some embodiments provide for control an electron beam current via one or more electrodes, such as the extraction electrode 140 and/or the downstream focusing electrode 150, and/or one or more beam protection electrode segments of the beam tube protection assembly 174. It may be noted that the use of such electrodes may enable a decoupling of the control of electron emission from the acceleration voltage or potential difference between the emitter 120 and the target 116.

In some embodiments, the extraction electrode 140 and/or the downstream focusing electrode 150 are configured for microsecond current control. For example, the electron beam current may be controlled on the order of microseconds by altering the voltage applied to one or more of the extraction electrode 140 or the downstream focusing electrode 150 on the order of microseconds. It may be noted the emitter 120 may be treated as an infinite source of electrons. In accordance with aspects of some embodiments, electron beam current, which is typically a flow of electrons from the emitter 120 toward the target 116, may be controlled by altering the voltage potential of one or more of the extraction electrode 140 or the downstream focusing electrode 150. In some embodiments, the size (e.g., width, diameter, cross-sectional area) of an electron beam may be controlled via control of the bias voltage of one or more of the extraction electrode 140 or the downstream focusing electrode 150. Further, in some embodiments, the intensity of the electron beam may also be controlled via control of the bias voltage of one or more of the extraction electrode 140 or the downstream focusing electrode 150.

In some embodiments, an electric field 170 is generated between the downstream focusing electrode 150 and the extraction electrode 140 due to a potential difference between the downstream focusing electrode 150 and the extraction electrode 140. The strength of the electric field 170 thus generated may be used to control the intensity and focusing of an electron beam generated by the emitter 120 towards the target 116. The intensity and size of the electron beam 102, for example, may therefore be controlled by controlling the strength of the electric field 170. For instance, the electric field 170 causes the electrons emitted from the emitter 120 to be accelerated towards the target 116. The configuration of the field 170 is selected so that the beam intensity and beam size at the target will meet desired values.

Furthermore, in some embodiments, voltage shifts (e.g., of about 8 kV or less) may be applied to one or more of the extraction electrode 140 or the downstream focusing electrode 150 (or portions thereof) to control the intensity of the electron beam 102. In some embodiments, these voltage shifts may applied to the extraction electrode 140 via use of the control electronics module 144 and the downstream focusing electrode 150 via use of the control electronics module 154. The voltage applied to one or more of the extraction electrode 140 or the downstream focusing electrode 150 may be changed in intervals from about 1-15 microseconds to intervals of about at least 150 milliseconds. In some embodiments, the control electronics modules 144, 154 may include Si switching technology circuitry to change the voltage applied to one or more of the extraction electrode 140 or the downstream focusing electrode 150. In some embodiments, where the voltage shifts may range beyond 8 kV, a silicon carbide (SiC) switching technology may be applied. Changes in voltage applied to one or more of the extraction electrode 140 or the downstream focusing electrode 150 thus may facilitate changes in intensity of the electron beam 102 in intervals of about 1-15 microseconds, for example. The control of the intensity of the electron beam on the order of microseconds may be referred to as microsecond intensity switching.

The X-ray tube assembly 100 depicted in FIG. 3 also includes an X-ray tube beam transport assembly 159 (e.g., X-ray tube beam transport assembly 30) including a magnetic assembly 160 for focusing and/or positioning and deflecting the electron beam 102 on the target 116, and a beam tube protection assembly 174 (e.g., beam tube protection assembly 40) for protecting the electron beam transport tube 163, determining a direction or path of the electron beam 102, and/or modifying the path or direction of electron beam 102 to protect the electron beam transport tube 163. In some embodiments, the beam tube protection assembly 174 and the magnetic assembly 160 may be disposed between the injector 110 and the target 116 (e.g. downstream of the extraction electrode 140, downstream of the downstream focusing electrode 150, and upstream of the target 116), and may be disposed axially about (and overlapping in the downstream direction) at least a portion of the electron beam transport tube 163. In the illustrated embodiment, the magnetic assembly 160 includes magnets 162 for influencing focusing and/or direction of the electron beam 102 by creating a magnetic field that shapes the electron beam 102 on the target 116. The magnets 162 may include or more quadrupole magnets, one or more dipole magnets, or combinations thereof. As the properties of the electron beam current and voltage may change rapidly, the effect of space charge and electrostatic focusing in the injector 110 will change accordingly. To help maintain a stable focal spot size, or quickly modify focal spot size according to system requirements, the magnetic assembly 160 may provide a magnetic field having a performance controllable from steady-state to a sub-30 microsecond time scale for a wide range of focal spot sizes. This helps provide protection of the X-ray source system, as well as achieving CT system performance requirements. In some embodiments, the beam tube protection assembly 174 includes a plurality of beam tube electrode segments that may be have independently adjustable voltages for steering, guiding, or re-directing the electron beam 102, as discussed above in connection with FIGS. 1 and 2.

Further, in some embodiments, the magnetic assembly 160 may include one or more dipole magnets for deflection and positioning of the electron beam 102 at a desired location on the X-ray target 116. The electron beam 102 that has been focused and positioned impinges upon the target 116 to generate the X-rays 180. The X-rays 180 generated by collision of the electron beam 102 with the target 116 may be directed from the X-ray tube assembly 100 through an opening in the tube casing 118, which may be generally referred to as an X-ray window 164, towards an object (not shown in FIG. 3.)

The electrons in the electron beam 102 may get backscattered after striking the target 116. Therefore, the X-ray tube assembly 100 may include an electron collector 166 for collecting electrons that are backscattered from the target 116. In some embodiments, the electron collector 166 may be maintained at a ground potential. In some embodiments, the electron collector 166 may be maintained at a potential that is substantially similar to the potential of the target 116. The electron collector 166 may be located proximate to the target 116 to collect the electrons backscattered from the target 116. For example, in some embodiments, the electron collector 166 may be located between the extraction electrode 140 and the target 116 (e.g. downstream of the extraction electrode 140 and upstream of the target 116), disposed closer to the target 116 than to the extraction electrode 140. The electron collector 166 may be formed from a refractory material, such as, but not limited to, molybdenum. As another example, the electron collector 166 may be formed from copper. In still another embodiment, the electron collector 166 may be formed from a combination of a refractory metal and copper.

In some embodiments, the X-ray tube assembly 100 may include a positive ion collector (not shown) to attract positive ions that may be produced due to collision of electrons in the electron beam 102 with the target 116. The positive ion collector is generally placed along the electron beam path and prevents the positive ions from striking various components in the X-ray tube assembly 100.

Figure 4:
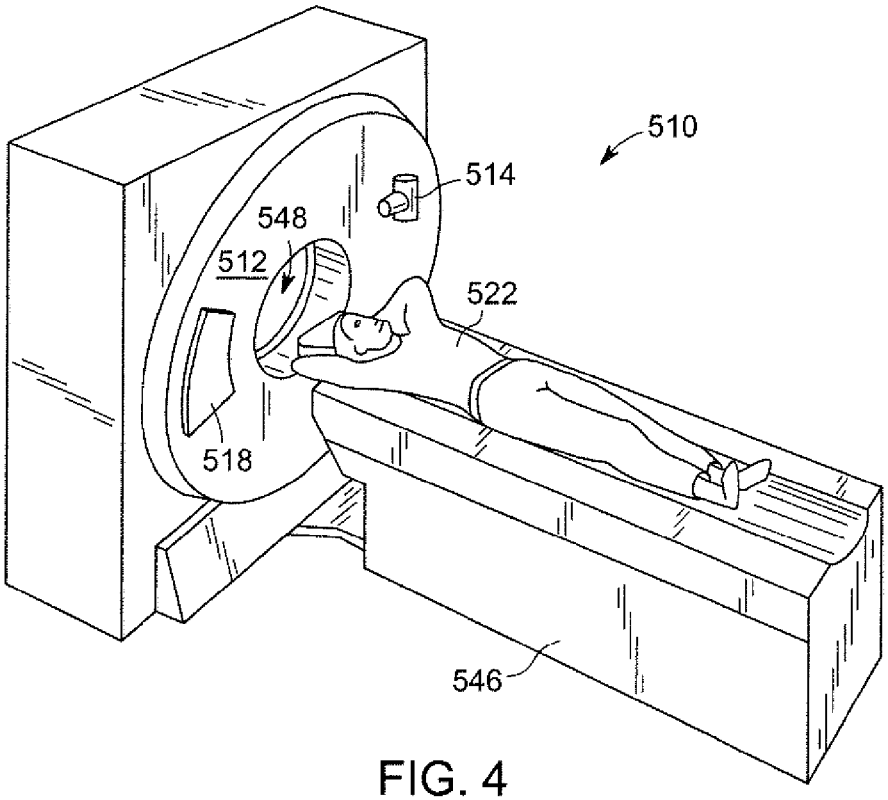
FIG. 4 is a pictorial view of a computed tomography (CT) imaging system in accordance with various embodiments.
Figure 5:
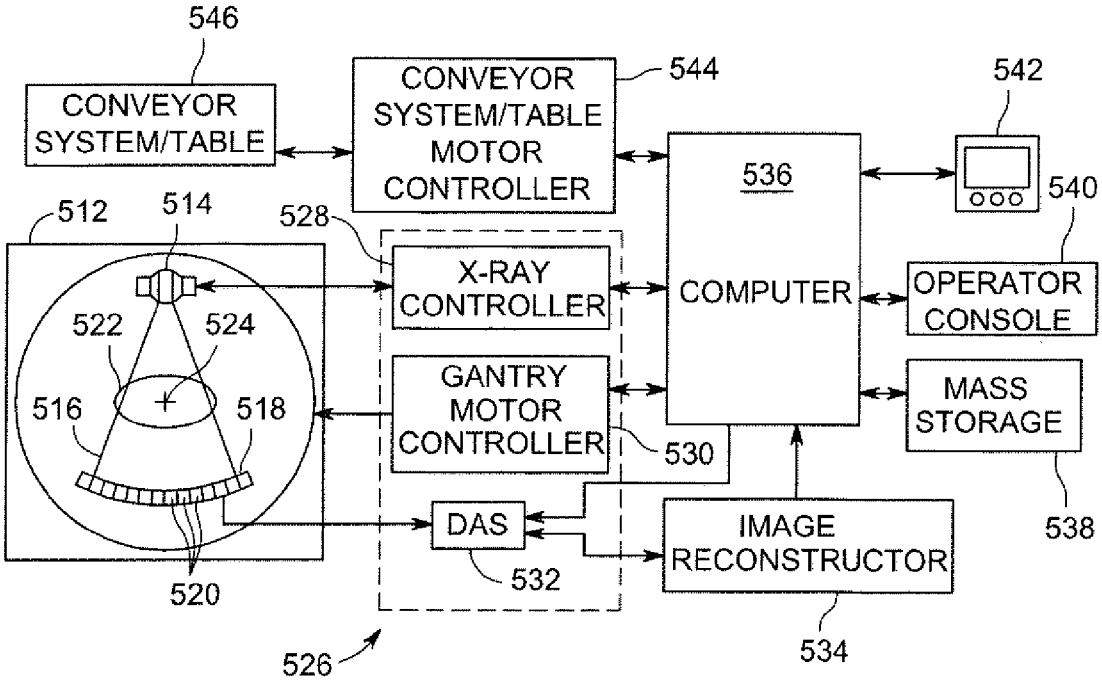
FIG. 5 is a block schematic diagram of the CT imaging system of FIG. 4 in accordance with various embodiments.

An X-ray assembly, such as the X-ray tube assembly 100, formed in accordance with various embodiments, may be used in conjunction with a computed tomography (CT) system. FIG. 4 provides a pictorial view of a computed tomography (CT) imaging system 510 in accordance with an embodiment, and FIG. 5 provides a block schematic diagram of the CT imaging system 510 of FIG. 4 in accordance with various embodiments. The CT imaging system 510 includes a gantry 512. The gantry 512 has an X-ray source 514 configured to project a beam of X-rays 516 toward a detector array 518 positioned opposite the X-ray source 514 on the gantry 512. The X-ray source 514 may include an X-ray tube assembly such as the X-ray tube assembly 100. In some embodiments, the gantry 512 may have multiple X-ray sources (e.g., along a patient theta or patient Z axis) that project beams of X-rays. The detector array 518 is formed by a plurality of detectors 520 which together sense the projected X-rays that pass through an object to be imaged, such as a medical patient 522. During a scan to acquire X-ray projection data, the gantry 512 and the components mounted thereon rotate about a center of rotation 524. While the CT imaging system 510 is described in connection with FIG. 5 with reference to the medical patient 522, it should be noted that the CT imaging system 510 may have applications outside of the medical realm. For example, the CT imaging system may 510 may be utilized for ascertaining the contents of closed articles, such as luggage, packages, etc., and in search of contraband such as explosives and/or biohazardous materials.

Rotation of the gantry 512 and the operation of the X-ray source 514 are governed by a control mechanism 526 of the CT system 510. The control mechanism 526 includes an X-ray controller 528 that provides power and timing signals to the X-ray source 514 and a gantry motor controller 530 that controls the rotational speed and position of the gantry 512. A data acquisition system (DAS) 532 in the control mechanism 526 samples analog data from the detectors 520 and converts the data to digital signals for subsequent processing. An image reconstructor 534 receives sampled and digitized X-ray data from the DAS 532 and performs high-speed reconstruction. The reconstructed image is applied as an input to a computer 536, which stores the image in a mass storage device 538.

Moreover, the computer 536 may also receive commands and scanning parameters from an operator via operator console 540 that may have an input device such as a keyboard (not shown in FIGS. 4 and 5). An associated display 542 allows the operator to observe the reconstructed image and other data form the computer 536. Commands and parameters supplied by the operator are used by the computer 536 to provide control and signal information to the DAS 532, the X-ray controller 528, and the gantry motor controller 530. Additionally, the computer 536 may operate a table motor controller 544, which controls a motorized table 546 to position the patient 522 and/or the gantry 512. For example, the table 546 may move portions of the patient 522 through a gantry opening 548. It may be noted that in certain embodiments, the computer 536 may operate a conveyor system controller 544, which controls a conveyor system 546 to position an object, such as baggage or luggage, and the gantry 512. For example, the conveyor system 546 may move the object through the gantry opening 548.

In some embodiments, the operator console 540 is configured to allow an operator to adjust an electron beam produced and used by an X-ray tube to produce an X-ray. For example, a controller (e.g., the X-ray controller 528) may, responsive to an operator input, vary the voltage of one or more beam tube protection electrode segments to re-direct an electron beam, for example to avoid contact with a portion of the X-ray tube assembly, to provide a wobble for improved imaging, and/or to direct an electron beam to a desired position on a target. In some embodiments, a controller (e.g., the X-ray controller 528) may autonomously determine a direction of an electron beam and control voltages supplied to one or more beam tube protection electrode segments (and/or one or more magnets) to re-direct the electron beam to eliminate and/or reduce contact between an electron beam and a portion of the X-ray tube assembly.

Figure 6:
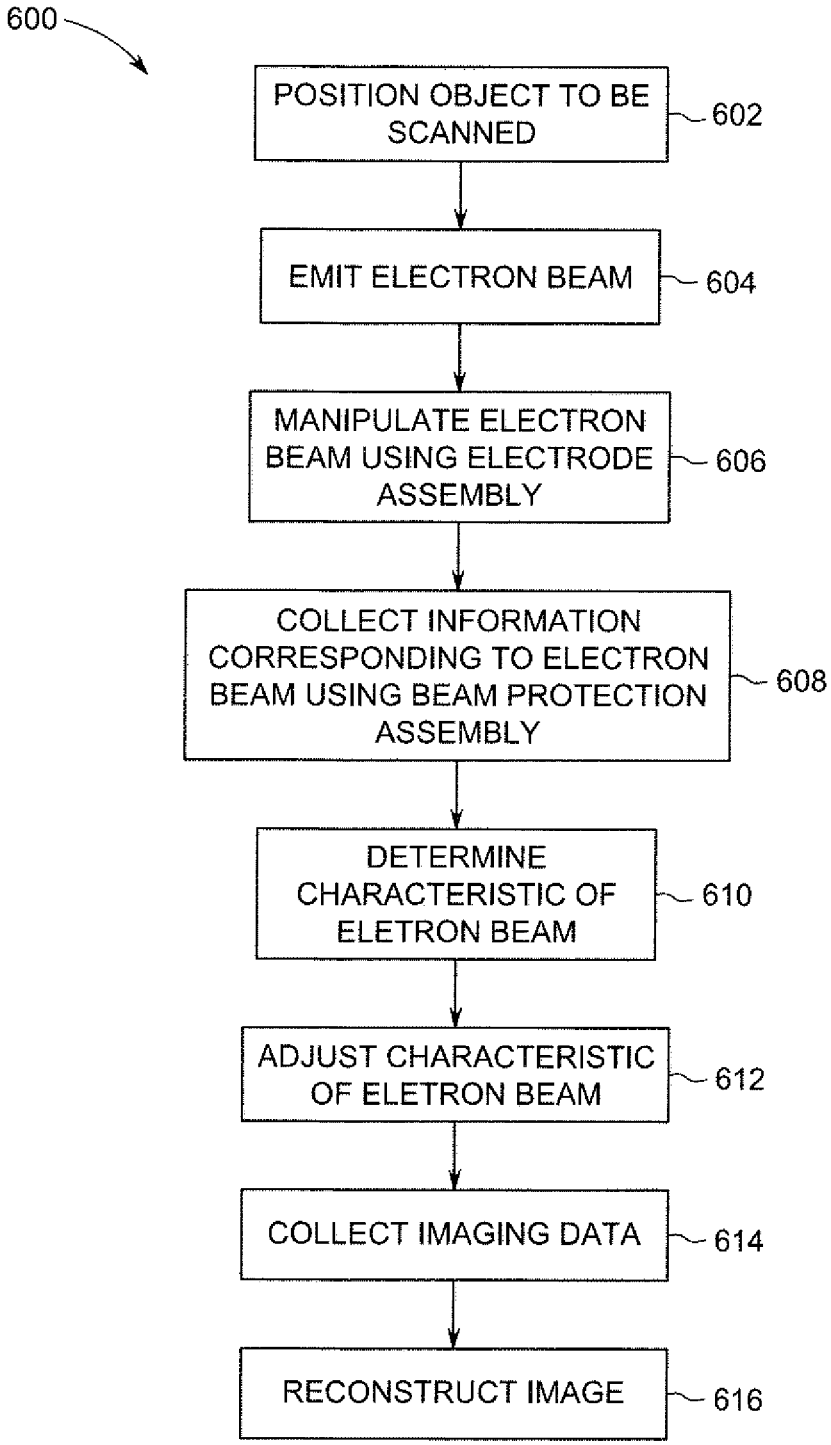
FIG. 6 is a flowchart of an exemplary method for providing an electron beam in accordance with various embodiments.

FIG. 6 is a flow chart of a method 600 for providing an X-ray beam in accordance with an embodiment. The method 600, for example, may employ structures or aspects of various embodiments discussed above. In various embodiments, certain steps may be omitted or added, certain steps may be combined, certain steps may be performed simultaneously, or concurrently, certain steps may be split into multiple steps, certain steps may be performed in a different order, or certain steps or series of steps may be re-performed in an iterative fashion.

At 602, an object to be scanned is positioned. For example, in some embodiments, the object may be a patient placed on a bed or table that is advanced through a gantry for performing a CT scan. As another example, in some embodiments the object may be a piece of luggage or a package that is placed on a conveyor belt and advanced to a scanning location.

At 604, an electron beam is emitted from an emitter (e.g., emitter 120). For example, an emitter (from which electrons are emitted) may be maintained at a negative voltage with respect to a target (toward which electrons are directed). For example, the target may be maintained at a positive voltage (e.g., about 140 kV) and the emitter maintained at about 0 V. As another example, the target may be maintained at about 0 V, and the emitter maintained at about −140 kV. The emitter may be heated directly or indirectly. As the electron beam proceeds downstream from the emitter toward the target, the electron beam proceeds through the extraction electrode and the downstream focusing electrode.

At 606, the electron beam is manipulated using an emitter focusing electrode (e.g., emitter focusing electrode 130) and/or one or more other electrodes of an electrode assembly (e.g., electrode assembly 128) positioned proximate the emitter.

The emitter focusing electrode may be, for example, a substantially continuous ring-shaped member disposed proximate to and at least partially surrounding (in an axial direction) the emitter. In some embodiments, the emitter focusing electrode is maintained at substantially the same voltage as the emitter, which may result in an electron beam having substantially parallel edges. In some embodiments, the emitter focusing electrode may be maintained at a negative bias voltage with respect to the emitter. One or more additional electrodes may be employed to further focus and/or manipulate an intensity of the electron beam, for example.

At 608, as the electron beam emitted from the emitter progresses in a downstream direction toward the target and passes through an electron beam transport tube, information corresponding to the electron beam is collected by a beam protection assembly (e.g., beam protection assembly 40). The beam protection assembly may include one or more beam protection electrode segments. For example, in some embodiments, the beam protection assembly may include four substantially similarly sized segments, each segment corresponding to a quadrant of a cylinder disposed proximate to an inner surface of the electron beam transport tube. The information may be collected by an indirect measurement of the electron beam (e.g., by a measurement of an induced voltage in one or more beam protection electrode segments due to the passage of the electron beam), or may be a measure of a direct contact between the electron beam and one or more beam protection electrode segments. The information may correspond to a current and/or a direction of the electron beam.

At 610, a characteristic of the electron beam is determined, for example by a control module that receives the information collected at 608. In some embodiments, a direction of an electron beam may be determined, for example, by comparing the relative amplitudes of induced voltage in a plurality of beam protection electrode segments. By way of example, if an induced voltage of two members of an opposed pair of beam protection electrode segments is substantially the same, the electron beam may be understood as passing centrally between the two segments. If an induced voltage of a first member of an opposed pair is greater than an induced voltage of the second member of the opposed pair, then the electron beam may be understood as passing closer to the first member of the opposed pair. In some embodiments, various voltage values and/or differences of beam protection electrode segments may be measured and/or tabulated during a calibration process to provide an experimentally derived formula or table for determining electron beam direction based on beam protection electrode segment voltages. A control module may be configured to use the experimentally derived formula or table to determine an electron beam direction using, for example, voltage values provided by beam protection electrode segments as the electron beam passes by the beam protection electrode segments. In some embodiments, a total current may be determined, for example, by a control module summing up or combining information provided by each of the beam protection electrode segments.

At 612, a characteristic of the electron beam is adjusted. The characteristic may be altered, for example, autonomously by one or more control modules. The characteristic may be adjusted responsive to the determination at 610. For example, if the current of the beam determined at 610 is higher or lower than desired, a voltage difference (e.g., a voltage difference between the emitter and the target) may be adjusted as appropriate. As another example, if the electron beam is determined at 612 to be a greater distance than desired from a preferred position, a lower distance than desired from a boundary position, and/or in contact with a beam protection electrode segment and/or an inner surface of the electron beam transport tube, then the voltages of the beam protection electrode segments may be adjusted to re-direct the electron beam toward a preferred or desired position or orientation. Additionally or alternatively, another aspect of an X-ray tube assembly (e.g., a magnetic assembly) may be controlled to re-direct the electron beam as desired. The characteristic, alternatively or additionally, may be adjusted to position the electron beam at a desired location on the target, and/or may be adjusted to provide a desired wobble in a resulting X-ray beam.

At 614, imaging data is collected or acquired during the performance of the scan. For example, a gantry including an X-ray source and associated components may rotate about an object being scanned, while a detector array (e.g., detector array 518) senses the projected X-rays that pass through the object. In other embodiments, imaging data may be collected while an object, such as a package or luggage, is advanced by a scanning area on a conveyor belt, carrousel, or other device. In still other embodiments, a scanning device and object being scanned may remain substantially stationary with respect to each other during a scan.

At 616, an image is reconstructed using the imaging data collected at 614. In some embodiments, an image reconstructor (e.g., image reconstructor 534) may receive sampled and digitized X-ray data and perform a high-speed reconstruction.

Thus, embodiments provide systems and methods wherein a beam protection assembly may be used to protect an electron beam transport tube. The beam protection assembly may be configured to protect the electron beam transport tube by providing a shield and/or by re-directing an electron beam passing through the electron beam transport tube. Further, the beam protection assembly may be used to detect or determine one or more characteristics of an electron beam, such as a direction or current. Further still, the beam protection assembly may be used to re-direct the electron beam to improve image quality, for example by directing the electron beam to a desired portion of a target, or, as another example, by inducing a desired wobble in the X-ray beam.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical drive, and the like. The storage device may also be other similar means for loading computer programs or other instructions into the computer or processor.

As used herein, the term "computer", "controller", and "module" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

What is claimed is:

1. An X-ray tube beam transport assembly comprising:

an electron beam transport tube configured to be interposed between an emitter and a target of an X-ray tube, the electron beam transport tube configured to form a part of a vacuum assembly, the electron beam transport tube comprising an opening configured for passage there through of an electron beam emitted by the emitter, the electron beam transport tube configured to be disposed peripherally about an axis defined by the electron beam, the electron beam transport tube including an inner surface bounding the opening along a length of the electron beam transport tube;

a beam tube protection assembly comprising a plurality of beam protection electrode segments disposed within the opening of the electron beam transport tube and proximate the inner surface of the electron beam transport tube, the plurality of beam protection electrode segments arranged about the axis defined by the electron beam and configured to protect the inner surface of the electron beam transport tube from contact with substantially all of the electron beam, wherein the plurality of beam protection electrode segments defines a cylinder surrounding the axis defined by the electron beam, the plurality of beam protection electrodes comprising four segments, each segment comprising defining a substantially circular arcuate segment corresponding to a quadrant of the cylinder; and a control module operably connected to the beam tube protection assembly, the control module configured to determine a direction of the electron beam responsive to information received from the beam tube protection assembly.

2. The assembly in accordance with claim 1, wherein the control module is configured to alter the direction of the electron beam using the information received from the beam tube protection assembly.

3. The assembly in accordance with claim 2, wherein the control module is configured to provide a first voltage to a first beam protection electrode segment and a second voltage to a second beam protection electrode segment, the first and second beam protection electrodes configured as members of an opposed pair, the first voltage and second voltage having different amplitudes, wherein the direction of the electron beam is modified as the electron beam passes through the electron beam transport tube.

4. The assembly in accordance with claim 2, wherein the control module is configured to provide voltages having a common polarity to an opposed pair of beam protection electrode segments, whereby the opposed pair is configured to focus the electron beam.

5. The assembly in accordance with claim 4, wherein the assembly includes a first opposed pair and a second opposed pair of beam protection electrode segments configured to provide an electrostatic quadrupole configured to focus the electron beam when the first opposed pair and the second opposed pair are provided with voltages having a common polarity.

6. The assembly in accordance with claim 1, further comprising a magnetic assembly disposed axially outward of the electron beam transport tube with respect to the axis defined by the electron beam, the magnetic assembly configured to manipulate a characteristic of the electron beam as the electron beam passes through the electron beam transport tube.

7. The assembly in accordance with claim 6, wherein the control module is configured to control the magnetic assembly to modify the direction of the electron beam as the electron beam passes through the electron beam transport tube.

8. The assembly in accordance with claim 1, wherein the control module is configured to turn off the electron beam responsive to information received from at least one of the beam protection electrode segments indicating a contact between the electron beam and the at least one of the plurality of beam protection electrode segments, wherein the electron beam is turned off by at least one of applying an appropriate voltage to an extraction electrode or turning off a heating element of the emitter.

9. The assembly in accordance with claim 1, wherein the control module is configured to determine a total current of the electron beam using the information received from the beam tube protection assembly.

10. The assembly in accordance with claim 1, wherein the information received from the beam tube protection assembly includes information corresponding to an induced voltage detected by at least one of the plurality of beam protection electrode segments.

11. The assembly in accordance with claim 1, wherein the information received from the beam tube protection assembly includes information corresponding to a contact between the electron beam and at least one of the plurality of beam protection electrode segments.

12. An X-ray tube assembly comprising:

an emitter configured to emit an electron beam defining a downstream direction, the emitter disposed proximate an upstream end of the X-ray tube assembly;

a target disposed proximate a downstream end of the X-ray tube assembly and configured to receive the electron beam emitted from the emitter, the target configured to provide an X-ray beam responsive to a collision of the electron beam with the target;

an electrode assembly disposed proximate the emitter and downstream of the emitter, the electrode assembly comprising at least one electrode having a bias voltage with respect to the emitter, the electrode assembly configured to surround the electron beam in an axial direction;

an electron beam transport tube interposed between the emitter and the target, the electron beam transport tube disposed downstream of the electrode assembly and upstream of the target, the electron beam transport tube configured to form a part of a vacuum assembly, the electron beam transport tube comprising an opening configured for passage there through of the electron beam emitted by the emitter, the electron beam transport tube configured to surround the electron beam in the axial direction, the electron beam transport tube including an inner surface bounding the opening along a length of the electron beam transport tube;

a beam tube protection assembly comprising a plurality of beam protection electrode segments disposed within the opening of the electron beam transport tube and proximate the inner surface of the electron beam transport tube, the plurality of beam protection electrode segments arranged about the axis defined by the electron beam and configured to protect the inner surface of the electron beam transport tube from contact with substantially all of the electron beam, wherein the plurality of beam protection electrode segments defines a cylinder surrounding the axis defined by the electron beam, the plurality of beam protection electrodes comprising four segments, each segment comprising defining a substantially circular arcuate segment corresponding to a quadrant of the cylinder; and a control module operably connected to the beam tube protection assembly, the control module configured to determine a direction of the electron beam responsive to information received from the beam tube protection assembly.

13. The assembly in accordance with claim 12, wherein the control module is configured to alter the direction of the electron beam using the information received from the beam tube protection assembly.

14. The assembly in accordance with claim 13, wherein the control module is configured to provide a first voltage to a first beam protection electrode segment and a second voltage to a second beam protection electrode segment, the first and second beam protection electrodes configured as members of an opposed pair, the first voltage and second voltage having different amplitudes, wherein the direction of the electron beam is modified as the electron beam passes through the electron beam transport tube.

15. The assembly in accordance with claim 13, further comprising a magnetic assembly disposed axially outward of the electron beam transport tube, the magnetic assembly configured to manipulate a characteristic of the electron beam as the electron beam passes through the electron beam transport tube, wherein the control module is configured to control the magnetic assembly to modify the direction of the electron beam as the electron beam passes through the electron beam transport tube.

16. The assembly in accordance with claim 12, wherein the control module is configured to turn off the electron beam responsive to information received from at least one of the beam protection electrode segments indicating a contact between the electron beam and the at least one of the plurality of beam protection electrode segments, wherein the electron beam is turned off by at least one of applying an appropriate voltage to an extraction electrode or turning off a heating element of the emitter.

17. The assembly in accordance with claim 12, wherein the control module is configured to provide voltages having a common polarity to an opposed pair of beam protection electrode segments, whereby the opposed pair is configured to focus the electron beam.

18. The assembly in accordance with claim 12, wherein the control module is configured to determine a total current of the electron beam using the information received from the beam tube protection assembly.

19. The assembly in accordance with claim 12, wherein the information received from the beam tube protection assembly includes information corresponding to an induced voltage detected by at least one of the plurality of beam protection electrode segments.

20. The assembly in accordance with claim 12, wherein the information received from the beam tube protection assembly includes information corresponding to a contact between the electron beam and at least one of the plurality of beam protection electrode segments.

21. A method for providing an electron beam, the method comprising:

emitting an electron beam toward a target, the electron beam defining a downstream direction from an emitter toward the target;

collecting information corresponding to the electron beam via a plurality of beam protection electrode segments as the electron beam passes through an electron beam transport tube configured to be interposed between the emitter and the target of an X-ray tube, the electron beam transport tube configured to form a part of a vacuum assembly, the electron beam transport tube including an inner surface bounding an opening along a length of the electron beam transport tube, the plurality of beam protection electrode segments disposed within the opening of the electron beam transport tube and proximate the inner surface of the electron beam transport tube, the plurality of beam protection electrode segments arranged about the axis defined by the electron beam and configured to protect the inner surface of the electron beam transport tube from contact with substantially all of the electron beam, wherein the plurality of beam protection electrode segments defines a cylinder surrounding the axis defined by the electron beam, the plurality of beam protection electrodes comprising four segments, each segment comprising defining a substantially circular arcuate segment corresponding to a quadrant of the cylinder; and determining, at a control module, a characteristic of the electron beam using information received from the plurality of beam protection electrode segments.

22. The method in accordance with claim 21, wherein the characteristic determined comprises a total beam current of the electron beam.

23. The method in accordance with claim 21, wherein the characteristic determined includes a direction of the electron beam.

24. The method in accordance with claim 23, further comprising modifying the direction of the electron beam using the information received from the plurality of beam protection electrode segments.

25. The method in accordance with claim 24, wherein the direction of the electron beam is altered by providing different voltages to members of an opposed pair of beam protection electrode segments.

26. The method in accordance with claim 23, further comprising shutting the electron beam off if it is determined that the electron beam is striking one or more beam protection electrode segments.

27. The method in accordance with claim 23, wherein the direction of the electron beam is altered via control of a magnetic assembly disposed axially outward of the electron beam transport tube.

28. The method in accordance with claim 21, further comprising focusing the electron beam by providing voltages with a common polarity to members of an opposed pair of beam protection electrode segments.

* * * * *